US006925782B2

(12) United States Patent
Aylward

(10) Patent No.: US 6,925,782 B2
(45) Date of Patent: Aug. 9, 2005

(54) VIBRATING PILL PACKAGING DEVICE AND ASSOCIATED METHOD

(75) Inventor: John T. Aylward, New Bern, NC (US)

(73) Assignee: Aylward Enterprises, Inc., New Bern, NC (US)

( * ) Notice: Subject to any disclaimer, the term of this patent is extended or adjusted under 35 U.S.C. 154(b) by 0 days.

(21) Appl. No.: 10/613,547

(22) Filed: Jul. 3, 2003

(65) Prior Publication Data

US 2005/0000192 A1 Jan. 6, 2005

(51) Int. Cl.[7] ..... B65B 5/00

(52) U.S. Cl. ..... 53/475; 53/246; 53/260; 53/539; 53/473

(58) Field of Search ..... 53/437, 473, 529, 53/438, 475, 245, 246, 260, 535, 539

(56) References Cited

U.S. PATENT DOCUMENTS 5,348,062 A * 9/1994 Hartzell et al. ..... 141/186
5,638,658 A * 6/1997 Black, Jr. ..... 53/399
5,653,092 A * 8/1997 Gorby et al. ..... 53/438
5,737,902 A 4/1998 Aylward

* cited by examiner

*Primary Examiner*—John Paradiso
(74) *Attorney, Agent, or Firm*—Alston & Bird LLP

(57) ABSTRACT

A packaging device for a pill packaging apparatus is provided, the packaging device cooperating with a plurality of pill receptacles, defined by a web and conveyed by a conveyor under the packaging device in a packaging direction, to manipulate pills deposited in the receptacles into a laid-down position. A first wiper device extends across the web, non-perpendicularly to the packaging direction, to engage pills protruding from the receptacles. A second wiper device downstream of the first wiper device extends across the web, substantially perpendicularly to the packaging direction, to engage any pills still protruding from the receptacles following engagement with the first wiper device. The first and second wiper devices oscillate substantially transversely to the packaging direction so as to vibrate laterally with respect to the web. The lateral vibration of the first and second wiper devices, as the wiper devices engage any protruding pills, thereby manipulates the protruding pills into the laid-down position in the corresponding receptacles. Associated devices, apparatuses, and methods are also provided.

36 Claims, 6 Drawing Sheets

VIBRATING PILL PACKAGING DEVICE AND ASSOCIATED METHOD

BACKGROUND OF THE INVENTION

1. Field of the Invention

The present invention relates to pill packaging apparatuses and methods and, more particularly, to a vibrating pill packaging device and associated method for packaging pills, tablets, capsules, and the like.

2. Description of Related Art

Pharmaceutical products such as pills, tablets, capsules, and the like are often packaged in disposable packaging for distribution to the consumer. Such disposable packaging includes thermoformed and cold formed blister packages as well as pouches, sachets, or disposable bottles.

Conventional blister packages typically include a generally planar web portion having a plurality of receptacles formed therein. A thermoforming process, for example, can be used to form the receptacles in a thermoplastic web. Each receptacle in the web may receive one or more pills and the receptacles may be arranged in a grid pattern having multiple rows and columns. After pills have been placed in all of the receptacles, an aluminum or plastic foil layer is typically adhered to the planar web portion to seal the pills within the receptacles.

An important aspect of forming these packages relates to the placement of the pills in the receptacles prior to the foil layer being applied. This procedure is preferably performed by an automated machine capable of precisely and accurately placing the pills into the receptacles at a high speed. An exemplary form of such an apparatus has been commercially available under the name, "Aylward Feed System" from Aylward® Enterprises, Inc. of New Bern, N.C., also the assignee of the present invention. The Aylward Feed System includes a feeder cassette and drop chute assembly having a plurality of chutes for guiding pills into the appropriate receptacles. An orienting tray is positioned above the feeder cassette for passing pills into the feeder cassette which, in turn, passes the pills into the drop chutes.

The orienting tray, the feeder cassette, and the drop chute assembly are mounted on a frame that extends over a conveyor having a series of empty pill blister packages placed thereon. The frame is generally movable in registration with the pill packages moving thereunder. The frame is fixed in the horizontal direction of the conveyor if the conveyor is an intermittent type. If the conveyor is a continuous type, the frame is moved on an undercarriage driven at the same speed as the conveyor. Therefore, with a continuous conveyor, the frame "gallops" back to register and moves with the next blister package after the preceding package has been filled.

Accordingly, as an empty pill package is moved under the drop chute, the drop chute is lowered and an escapement mechanism is activated in the feeder cassette to release a single pill that falls through the drop chute and into the corresponding receptacle in the package. More particularly, for example with blister packages, the drop chute is lowered and a pill is released to fall through the drop chute until it engages the bottom of the blister. The frame is then raised which, in turn, raises the drop chute and deposits the pill in the blister. This operation defines a gravity feed pill packaging system.

The drop chute assembly may include a plurality of individual chutes arranged in a block so as to define a grid.

Each of the chutes extends in a generally vertical direction, but may include a portion at the lower end thereof which is angled so that a pill exiting the drop chute does so at an acute angle relative to the blister package.

In operation, where a pill is being packaged in a loose-fitting receptacle, this type of system will often place a pill into the blister receptacle by sliding a pill down the drop chute, wherein the lower end thereof is angled so that a pill exiting the drop chute is placed in the blister package at an acute angle relative thereto. Since the pill is deposited into the receptacle at an angle, it will sometimes "slide" into the receptacle until the leading edge of the pill engages a side wall thereof. The drop chute is then moved away from the blister receptacle to allow the trailing edge of the pill to clear the drop chute and drop into the receptacle under the force of gravity. Thus, the pill is introduced to the receptacle, essentially diagonally, at an angle corresponding to the angle of the lower end of the drop chute. An apparatus and method of this type for packaging pills is disclosed in U.S. Pat. No. 5,737,902 to Aylward, which is incorporated herein in its entirety by reference.

Although these types of feeders have achieved widespread commercial acceptance, problems may arise if the pills are being deposited into a package having receptacles that are closely toleranced or "tight fitting" with respect to the dimensions of the pills. Tight fitting receptacles are desirable in some instances, such as in blister packaging, wherein the tight tolerances minimize rattling of the pills within the receptacles. However, where a pill is to be inserted into a tightly toleranced receptacle using these types of systems, the pill may not be capable of simply being slid into the receptacle in a diagonal orientation.

For example, for a caplet generally having the shape of a transversely flattened capsule, the dimensions of the receiving receptacle in the blister package may be only slightly greater than the dimensions of the caplet. That is, the overall length and width of the receptacle may only be slightly greater than the overall length and width of the caplet, respectively. Accordingly, when the caplet is slid into the receptacle at an angle with the leading edge of the caplet dropping into the receptacle and engaging a side wall thereof before the trailing edge is released, the caplet may become oriented with its diagonal dimension approximately parallel or angled slightly upward relative to the planar web portion of the blister package. In this situation, the maximum dimension of a longitudinal cross-section of the caplet, here the diagonal dimension, may be slightly greater than the length of the accommodating receptacle and thus the trailing edge of the caplet will lie against a portion of the side wall of the receptacle, above the bottom wall thereof. The force of gravity may not be sufficient to cause the pill to drop fully into the receptacle, which leaves part of the trailing edge of the caplet extending above the planar web portion of the blister packet. This can also occur if the blister package material is wrinkled or otherwise distorted in the bottom or sides of the receptacle. In some instances, a caplet or pill may even "stand up" on its leading edge within a receptacle. As can be appreciated, these occurrences may have an adverse effect on the subsequent application of the foil layer if the trailing edge of the caplet or pill extends above the plane of the blister package.

Thus, there exists a need for an improved packaging apparatus and method for placing pills and the like into pill receptacles such as blister packages in a preferred orientation, more particularly in the receptacle and below the planar web portion of the blister package, before application of a sealing foil layer. Such an apparatus and method should be able to quickly and accurately insert the pills, even the pills that are "standing up," into the receptacles to provide high packaging speed and quality. Such an apparatus and method should also be capable of efficiently and reliably inserting pills into receptacles dimensioned in close tolerance to the pills.

BRIEF SUMMARY OF THE INVENTION

The above and other needs are met by the present invention which, in one embodiment provides a packaging device for a pill packaging apparatus, wherein the packaging device cooperates with a plurality of pill receptacles, defined by a web and being conveyed by a conveyor under the packaging device in a packaging direction, to manipulate pills deposited in the receptacles into a laid-down position with respect to the receptacles. Such a packaging device comprises a first wiper device, extending across the web and non-perpendicularly to the packaging direction, configured to engage pills protruding from the receptacles. A second wiper device, downstream of the first wiper device and extending across the web substantially perpendicularly to the packaging direction, is configured to engage any pills still protruding from the receptacles following engagement with the first wiper device. The first and second wiper devices are configured to oscillate substantially transversely to the packaging direction so as to vibrate laterally with respect to the web. The lateral vibration of the first and second wiper devices, as the wiper devices engage any protruding pills, thereby causes the protruding pills to be manipulated into the laid-down position in the corresponding receptacles.

Another advantageous aspect of the present invention comprises a packaging device for a pill packaging apparatus, wherein the packaging device cooperates with a plurality of pill receptacles, defined by a web and being conveyed by a conveyor under the packaging device in a packaging direction, to manipulate pills deposited in the receptacles into a laid-down position with respect to the receptacles. Such a packaging device includes a first wiper device, extending across the web and non-perpendicularly to the packaging direction, configured to engage pills protruding from the receptacles. A second wiper device, disposed downstream of the first wiper device and extending across the web substantially perpendicularly to the packaging direction, is configured to engage any pills still protruding from the receptacles following engagement with the first wiper device. A plate extends across the web and supports the first and second wiper devices, wherein the plate is configured to oscillate substantially transversely to the packaging direction so as to cause the first and second wiper devices to vibrate laterally with respect to the web. The lateral vibration of the first and second wiper devices, as the wiper devices engage any protruding pills, thereby causes the protruding pills to be manipulated into the laid-down position in the corresponding receptacles.

Still another advantageous aspect of the present invention comprises a pill packaging apparatus for packaging pills in a plurality of pill receptacles defined by a web. Such a pill packaging apparatus includes a conveyor for conveying the web in a packaging direction and a feeder mechanism configured to deposit pills into the receptacles. A packaging device is disposed downstream of the feeder mechanism with respect to the conveyor and further includes a first wiper device extending across the web and non-perpendicularly to the packaging direction, wherein the first wiper device is configured to engage pills protruding from the receptacles. A second wiper device is disposed downstream of the first wiper device and extends across the web substantially perpendicularly to the packaging direction. The second wiper device is configured to engage any pills still protruding from the receptacles following engagement with the first wiper device. The first and second wiper devices are further configured to oscillate substantially transversely to the packaging direction so as to vibrate laterally with respect to the web. The lateral vibration of the first and second wiper devices, as the wiper devices engage any protruding pills, thereby causes the protruding pills to be manipulated into the laid-down position in the corresponding receptacles.

Yet another advantageous aspect of the present invention comprises a method for packaging pills in individual receptacles in a web being conveyed in a packaging direction. First, pills are deposited into the receptacles in the web. A first wiper device, disposed non-perpendicularly with respect to the packaging direction, then engages any pills protruding from the receptacles. A second wiper device, disposed substantially perpendicularly with respect to the packaging direction, is then engaged with any pills still protruding from the receptacles following engagement with the first wiper device. The first and second wiper devices are concurrently oscillated substantially transversely to the packaging direction such that the first and second wiper devices vibrate laterally with respect to the web. The lateral vibration of the first and second wiper devices, as the wiper devices engage any protruding pills, thereby causes the protruding pills to be manipulated into a laid-down position in the corresponding receptacles.

Thus, embodiments of the present invention provide significant advantages as disclosed, described, and further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
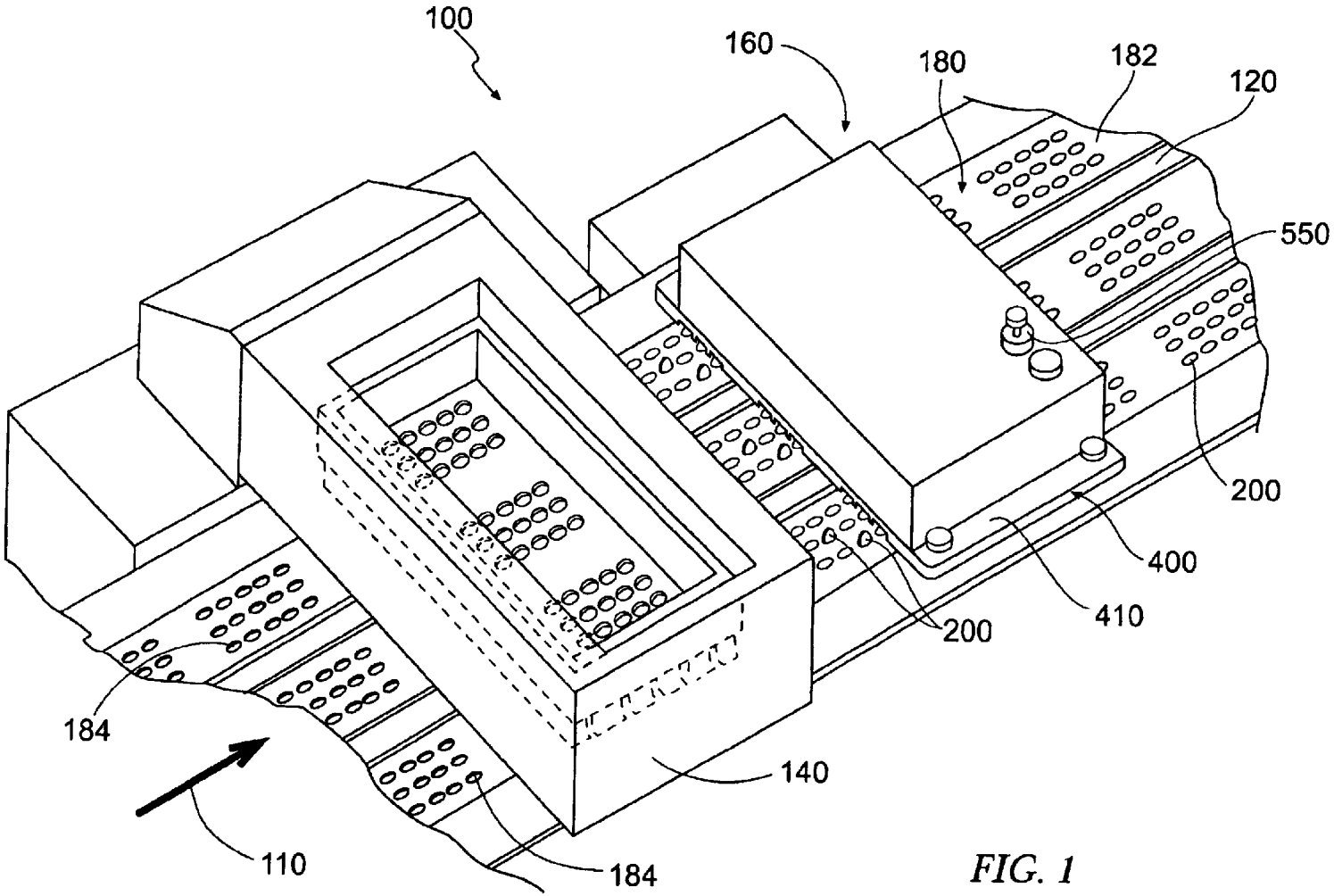
FIGS. 1 and 2 are schematic perspective views of a pill packaging apparatus including a packaging device according to one embodiment of the present invention.
Figure 2:
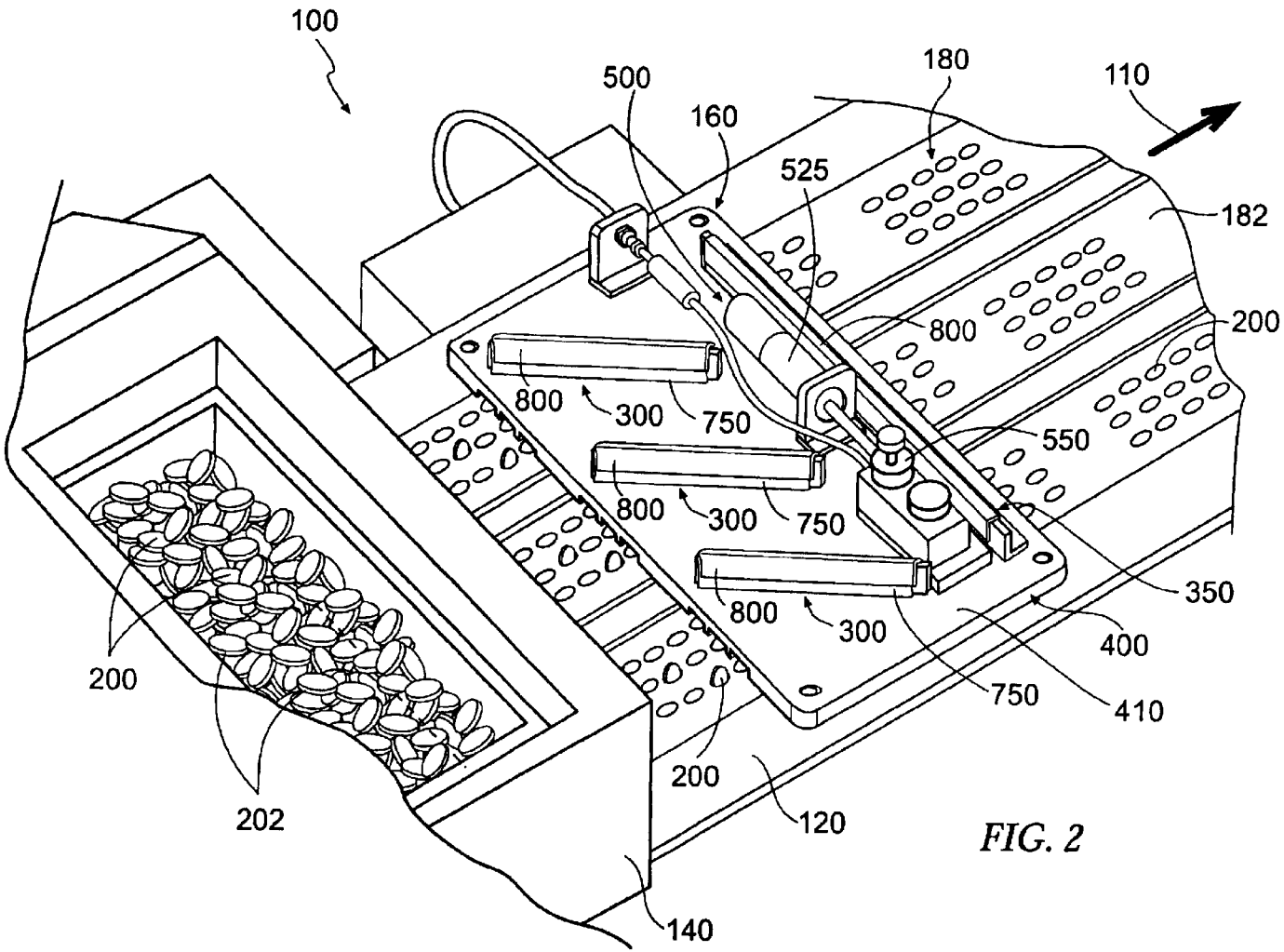
Figure 3:
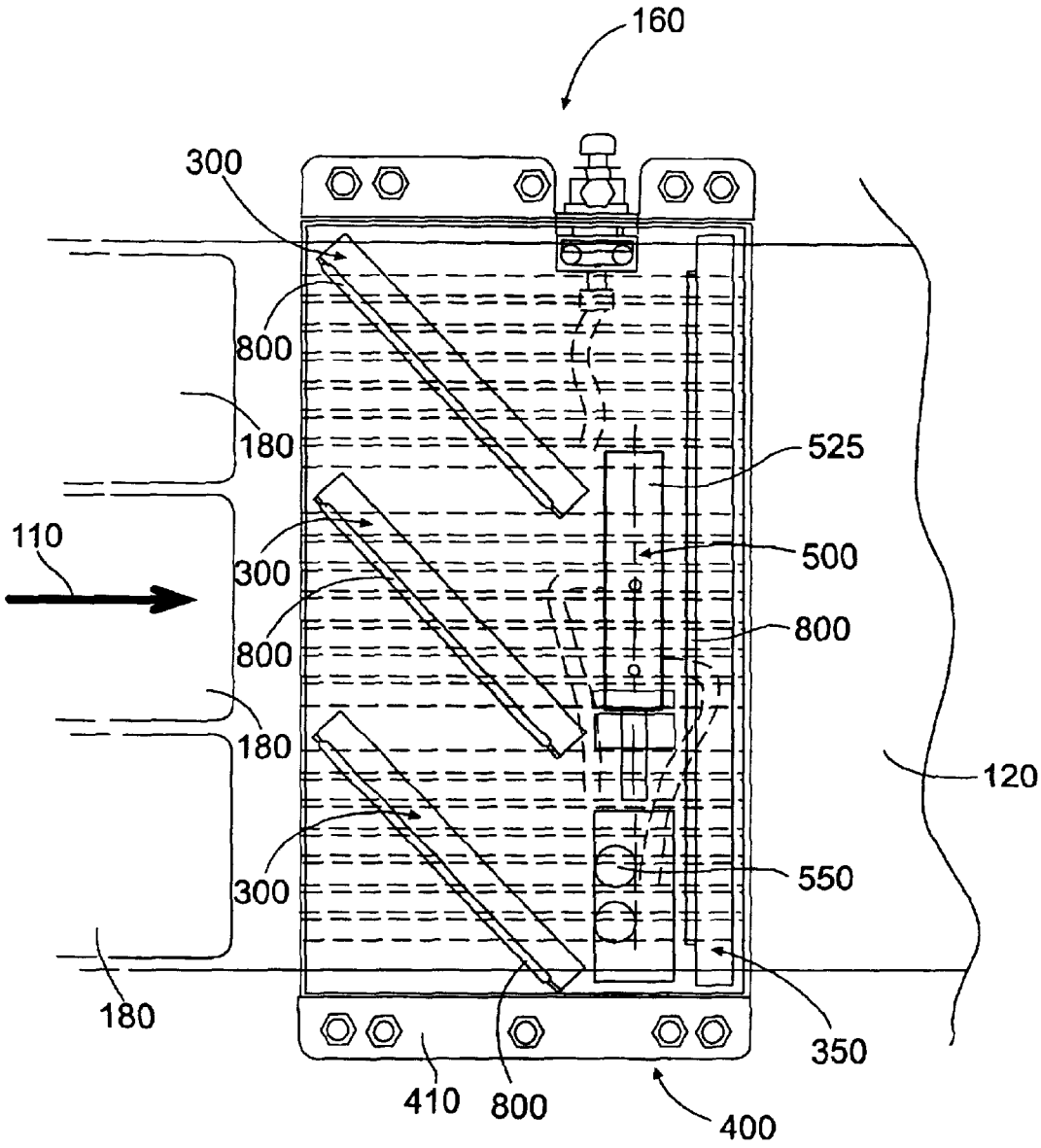
FIG. 3 is a schematic plan view of a packaging device according to one embodiment of the present invention.

FIGS. 1 and 2 disclose one embodiment of a pill packaging apparatus, indicated generally by the numeral 100, for packaging pills in a series of pill receptacles. The pill packaging apparatus 100 generally comprises a conveyor 120, a feeder mechanism 140 extending over the conveyor 120, and a packaging device 160 disposed downstream of the feeder mechanism 140 with respect to the conveyor 120. Typically, the conveyor 120 conveys a series of blister packages 180 generally horizontally along the travel path of the conveyor 120. The feeder mechanism 140 deposits pills 200 into the blister packages 180 in a predetermined manner as the blister packages 180 are transported by the conveyor 120. A more detailed description of an apparatus having a feeder mechanism for supplying pills into a series of pill receptacles being transported on a conveyor thereunder may be found, for example, in U.S. Pat. No. 5,737,902 to Aylward.

As used herein, the term "pill" is intended to include all types of small discrete products of the type which may be used in the pharmaceutical industry, including pills, tablets, capsules, caplets, and soft gel caplets or the like. Similarly, the packages are illustrated as blister packages having blisters that may be formed by thermoforming if the packages are made from a thermoplastic material. It will be understood, however, that the present invention is not limited to placing pills into blister packages, but indeed may be used for placing pills into a variety of different pill receptacles. In addition, it will be understood that the present invention is not limited to placing pills into disposable pill packages, but may also be used for placing pills into reusable holders so that the pills may then be transferred to other operations, such as a pill placement device for moving the pills from the holder into a disposable package. Thus, the examples disclosed herein with respect to embodiments of the present invention are not intended to be limiting or restricting, and one skilled in the art will appreciate that the apparatuses and methods disclosed herein may also be applicable to many different configurations of pill packaging apparatuses and associated methods.

The blister packages 180 typically comprise, for instance, a generally planar web portion 182 and a plurality of receptacles 184 extending below the web portion 182. As the blister packages 180 pass underneath the feeder mechanism 140 in a packaging direction (shown as arrow 110), at least one pill 200 is typically released into each receptacle 184. Once pills 200 have been deposited into each receptacle 184, the receptacles 184 are typically sealed with a foil or other sealing layer (not shown) applied to the planar web portion 182.

Figure 4:
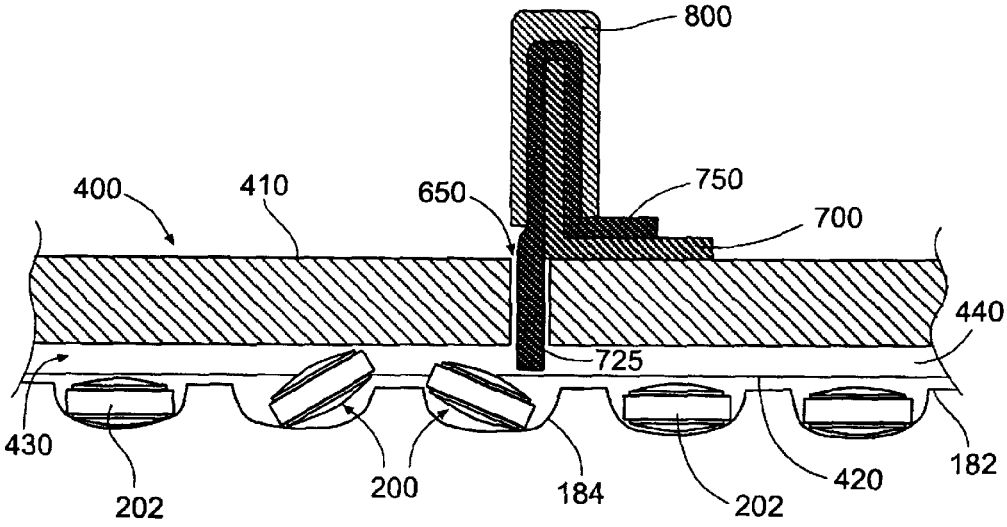
FIG. 4 is a schematic cross-sectional view of a wiper device component of a packaging device according to one embodiment of the present invention.
Figure 5:
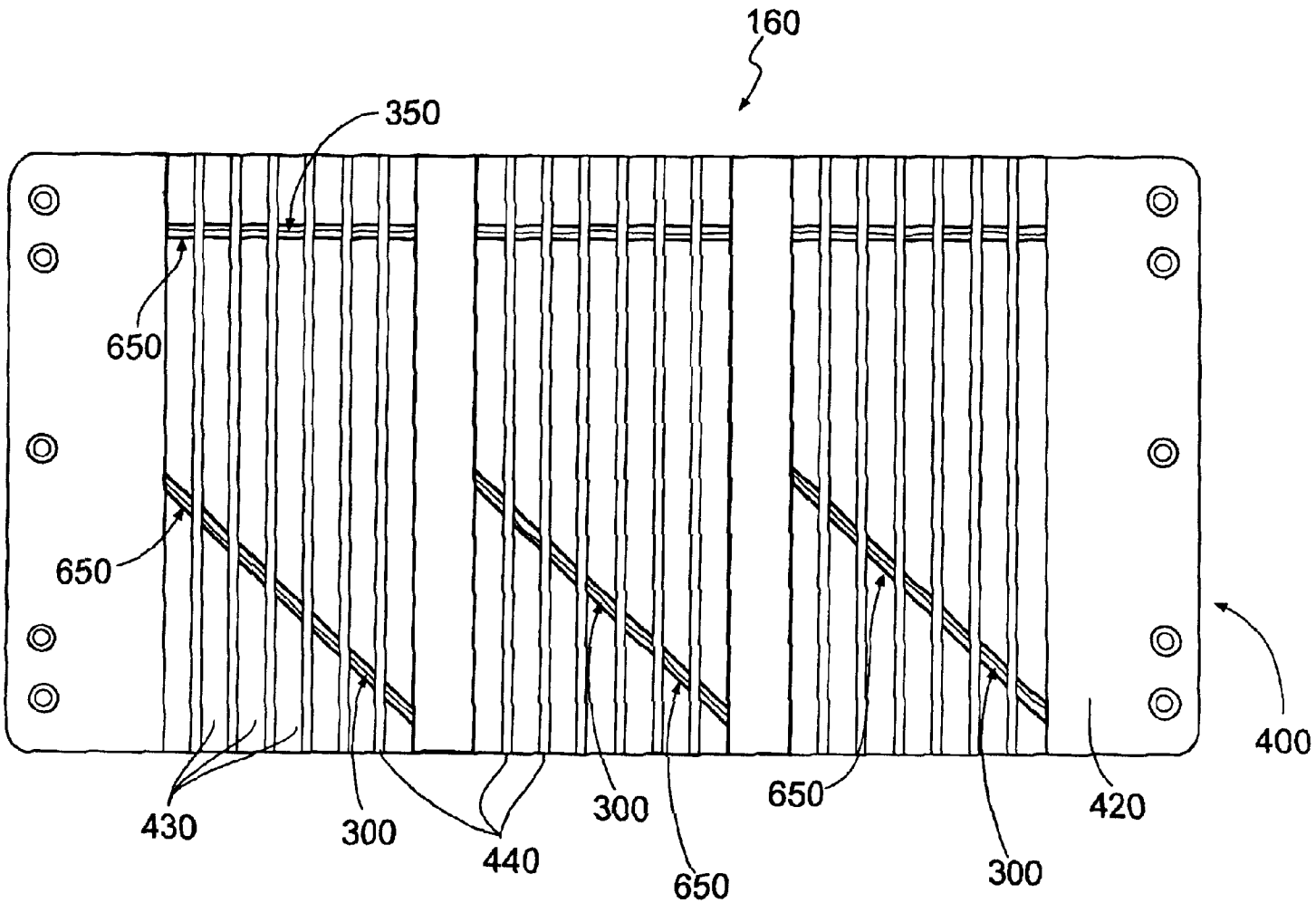
FIG. 5 is a schematic bottom view of a packaging device according to one embodiment of the present invention.
Figure 6:
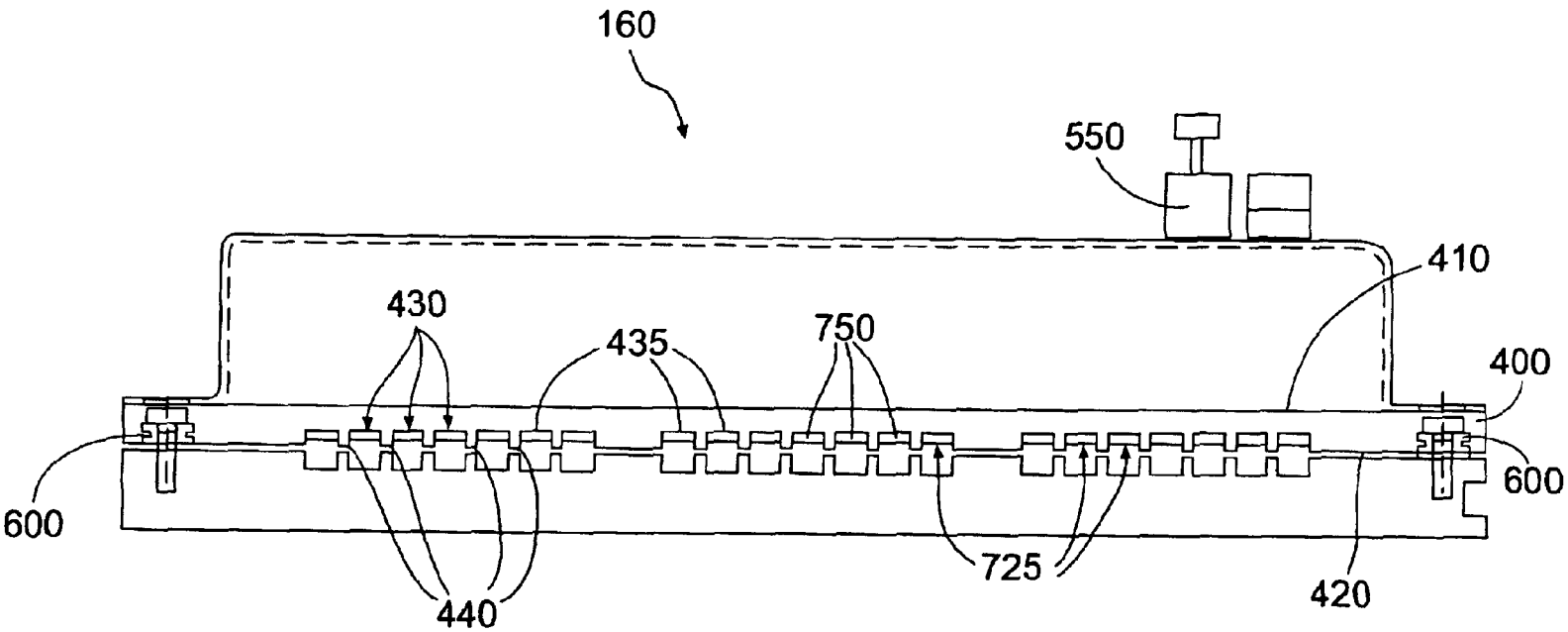
FIG. 6 is a schematic front view of a packaging device according to one embodiment of the present invention.

In some instances, for example, where the receptacles 184 are dimensioned in close tolerance to the pills 200, the pills 200 may not lie flat within the receptacles 184 after being deposited therein by the feeder mechanism 140, as shown in FIGS. 1, 2, and 4. Accordingly, such pills 200 are referred to herein as "protruding" from the receptacles 184. The protruding pills 200 may, for example, lie against the opening of the receptacle 184 at the planar web portion 182 or, where the pills 200 have a flat band 202 extending around the perimeter thereof, the pills 200 may even "stand up" on the band 202 within the receptacle 184. In such instances, the sealing layer may be difficult to apply or not capable of being applied to the planar web portion 182 to seal pills 200 within the receptacles 184. Thus, after each blister package 180 has passed under the feed mechanism 140 and has received the appropriate amount of pills 200 therein, the blister packages 180 are serially conveyed downstream in the packaging direction 110 by the conveyor 120 to pass under the packaging device 160 for manipulating any protruding pills 200 into the desired flat orientation or "laid-down position" within the individual receptacles 184.

As shown in FIGS. 2–6, a packaging device 160 according to embodiments of the present invention includes at least one first wiper device 300 configured to be capable of engaging at least some pills 200 protruding from the receptacles 184. Preferably, the first wiper device 300 extends across the blister package 180 and is disposed non-perpendicularly with respect to the packaging direction 110. In one advantageous embodiment, the first wiper device 300 is disposed at an angle of about 45° with respect to the packaging direction 110, though one skilled in the art will appreciate that the angle may vary. Since the embodiment shown in FIGS. 1–6 includes three series of blister packages 180 being conveyed in the packaging direction 110 by the conveyor 120, three such first wiper devices 300 are illustrated, wherein each first wiper device 300 is configured to interact with a respective one of the series of blister packages 180. Each first wiper device 300 is configured to extend across a series of blister packages 180 so as to be capable of engaging pills 200 protruding from the receptacles 184.

The packaging device 160 further includes at least one second wiper device 350 disposed downstream of the first wiper device(s) 300 and substantially perpendicularly with respect to the packaging direction 110. In the embodiment shown in FIGS. 1–6, a single second wiper device 350 extends across the three series of blister packages 180, though one skilled in the art will appreciate that the second wiper device 350 may vary in number if desirable. The second wiper device 350 is thus configured to extend across the series of blister packages 180 engaged by the corresponding first wiper device 300 so as to be capable of engaging any pills 200 still protruding from the receptacles 184 following engagement with the first wiper device 300.

In one advantageous embodiment of the present invention, the first and second wiper devices 300,350 are further configured to vibrate when engaging protruding pills 200 so as to manipulate the protruding pills 200 into the laid-down position within the corresponding receptacle 184 in the blister package 180. More particularly, in some embodiments, the first and second wiper devices 300,350 are configured to oscillate transversely with respect to the packaging direction 110 and at a sufficient frequency such that the first and second wiper devices 300,350 essentially laterally vibrate with respect to the series of blister packages 180 being conveyed by the conveyor 120. In this manner, the laterally vibration of the first and second wiper devices 300,350 and the contact between the first and second wiper devices 300,350 and the pills 200 protruding from the receptacles 184 combine to manipulate the protruding pills 200 into the laid-down position within the corresponding receptacles 184.

As shown, the first and second wiper devices 300,350, in some instances, are mounted to a plate 400, wherein the plate 400 is configured to support the first and second wiper devices 300,350 above the blister packages 180 being conveyed by the conveyor 120 so as to allow the first and second wiper device 300,350 to engage any pills 200 protruding from the receptacles 184. One skilled in the art will further appreciate that the pill packaging apparatus 100, as described, may be configured as a continuous motion pill packaging apparatus, wherein the conveyor 120 continuously conveys the blister packages 180, and an indexing pill packaging apparatus, wherein the blister packages 180 are moved in successive discrete indices such that one blister package 180 at a time is acted upon by the feeder mechanism 140 and packaging device 160. Where the pill packaging apparatus 100 is a continuous motion pill packaging apparatus, the packaging device 160 as described herein may be configured to be stationary with respect to the conveyor 120 so as to act on the protruding pills 200 as the blister packages 180 are continuously conveyed under the plate 400. In instance where the pill packaging apparatus 100 is an indexing pill packaging apparatus, the packaging device 160 may be stationary and configured to act one the protruding pills 200 as the blister packages 180 are moved to the next successive discrete index. In other instances, the packaging device 160 may be configured to move with respect to the blister packages 180 so as to act on the protruding pills 200 as the blister packages 180 are between indices and stationary on the conveyor 120. After acting on the protruding pills 200 in a particular blister package 180, the packaging device 160 is then returned to register to await the next blister package 180 at the next index of the conveyor 120.

Some embodiments of the packaging device 160 may also include a vibration-inducing device 500 engaged with the plate 400 for facilitating the transverse oscillation of the first and second wiper devices 300,350. The vibration-inducing device 500 may particularly comprise, for example, a pneumatic vibrator 525 for producing the necessary vibration, controlled by a frequency controller 550 for controlling the frequency of the vibration, though one skilled in the art will appreciate that the transverse oscillation of the first and second wiper devices 300,350 may be accomplished in many different manners such as, for example, by using a piezoelectric device. The pneumatic vibrator 525, in one instance, is mounted to the plate 400 substantially transversely to the packaging direction 110 such that, upon actuation, the lateral vibration is transmitted to the first and second wiper devices 300,350 via the plate 400. However, one skilled in the art will appreciate that, in some cases, the packaging device 160 may be configured so as to allow the vibration-inducing device 500 to vibrate the first wiper device 300 at a different frequency from the second wiper device 350.

In some cases, it may be advantageous to isolate the vibration produced by the vibration-inducing device 500 from the conveyor 120. For example, such vibration isolation may be advantageous in reducing or eliminating blurred vision data in vision systems used along the pill packaging apparatus 100. Accordingly, the plate 400 may be mounted to the conveyor 120 via mounting members 600, wherein the mounting members 600 are configured in such case to dampen the vibrations or otherwise substantially isolate the conveyor 120 from the vibrations. For example, the mounting members 600 may comprise a solid resilient member or a hydraulic dampening device, as will be appreciated by one skilled in the art. In the alternative, the plate 400 may be supported by a separate frame (not shown) extending over the conveyor 120, with the frame including vibration-dampening provisions.

As also shown in FIGS. 2–6, the first and second wiper devices 300,350, in some embodiments, are configured to be mounted to an upper surface 410 of the plate 400 and extend through respective slots 650 defined by the plate 400 so as to be capable of engaging the protruding pills 200. One advantage of such a configuration is that the first and second wiper devices 300,350 may be accessed from above the plate 400 without having to remove the plate 400 from the mounting position above the conveyor 120. Further, the first and second wiper devices 300,350 should be mounted with respect to the plate 400 so as to be capable of manipulating the protruding pills 200 into the laid-down position within the receptacles 184, but without dragging the pills 200 out of the receptacles 184 and/or without causing damage to the pills 200 or corresponding receptacles 184 by trapping the protruding pills 200 against the planar web portion 182/receptacle 184 interface. Accordingly, the first and second wiper devices 300,350 are mounted to the plate 400 in spaced apart relation with respect to the planar web portion 182 so as to be capable of engaging the protruding pills 200, but without causing the aforementioned undesirable effects, as will be appreciated by one skilled in the art In some instances, the receptacles 184 are arranged in columns with respect to the packaging direction 110 in the blister package 180. As such, it would also be undesirable for the lateral vibration of the first and second wiper devices 300,350 to move a protruding pill 200 to a different column in the blister package 180. Accordingly, in such instances, the lower surface 420 of the plate 400 defines a plurality of channels 430 extending in the packaging direction 110 and corresponding to the columns of receptacles 184 in the blister package 180. Adjacent channels 430 are separated by a tine 440 having a width roughly corresponding to the separation distance between adjacent columns in the blister package 180, wherein each tine 440 is configured to extend into proximity with the planar web portion 182 of the blister package 180 so as to prevent movement of pills 200 between columns. Each channel 430 extends toward the upper surface 410 of the plate 400 and ends in an upper bound 435. As such, in order for the first and second wiper devices 300,350 to engage the protruding pills, each slot 650 extends through the upper bounds 435 of the channels 430 and partially through the tines 440 separating the channels 430, as shown in FIG. 4. One skilled in art will also appreciate that the separate channels 430 and the limited transverse translation of the first and second wiper devices 300,350, while the first and second wiper devices 300,350 are laterally vibrated, may also reduce or eliminate cross-contamination in instances where the pills 200 loaded into one column of the blister package 180 are different from the pills 200 loaded into an adjacent column.

One skilled in art will also appreciate that there may be instances in which the pills 200 loaded into one row of the blister package 180, transverse to the packaging direction 110, are different from the pills 200 loaded into the next adjacent row. For example, two different types of pills 200 may be loaded in alternating rows in the blister package 180. In such instances, two packaging devices 160 as described herein may be provided, or a single packaging device 160 with two sets of first and second wiper devices 300,350, whereby each packaging device 160 or each set of first and second wiper devices 300,350 is configured to act upon every other row of the blister package 180 and thus interact with only one type of pill 200 during the packaging process. Accordingly, a pill packaging apparatus 100 configured in such a manner may also reduce or eliminate cross-contamination between the adjacent rows of the blister package 180.

In some embodiments of the present invention, the first and second wiper devices 300,350 may comprise, for example, a cloth material or other material approved by the appropriate regulatory agency as being suitable for use in pharmaceutical packaging operations. In the alternative, for example, the first and second wiper devices 300,350 may comprise an appropriately configured rubber or polymer material. The material comprising the first and second wiper devices 300,350 thus functions as a wiper and should be capable of manipulating the protruding pills 200 into the receptacles 184 without causing abrasion of or otherwise damaging the pills 200.

In cases where the first and second wiper devices 300,350 are comprised of a cloth material, the packaging device 160 may include one or more support members 700 disposed adjacent to and extending along the length of each slot 650. The support members 700 are configured such that, when a straight edge 725 of a strip 750 of the cloth material is inserted into a slot 650, the remainder of the strip 750 may be folded over the support member(s) 700 and secured thereto by one or more clip members 800. Preferably, the strip 750 extends substantially along the length of the corresponding slot 650, with the support member(s) 700 and corresponding clip member(s) 800 cooperating to secure the strip 750 to the plate 400 and contiguously support the strip 750 along the length of the respective slot 650 so as to facilitate the lateral vibration of the strip 750. In this manner, the strip 750 is also readily removable through removal of the clip member(s) 800 securing the strip 750 to the support member(s) 700. As such, the strip 750 may be easily replaced when worn out or to prevent cross-contamination in a subsequent pill packaging process. One skilled in the art will appreciate, however, that the first and second wiper devices 300,350 may be configured in other manners. For example, the strip 750 may be permanently attached to the support member(s) 700 to form a wiper assembly, wherein the support member(s) 700 may be configured to be capable of removably engaging the plate 400 such that the entire wiper assembly is replaced when necessary.

Many modifications and other embodiments of the invention set forth herein will come to mind to one skilled in the art to which this invention pertains having the benefit of the teachings presented in the foregoing descriptions and the associated drawings. For example, the procedure described herein supports a method of packaging pills 200 in receptacles 184 in a blister package 180. More particularly, after depositing the pills 200 into the receptacles 184, the first wiper device 300 disposed non-perpendicularly with respect to the packaging direction 110 is brought into engagement with any pills 200 protruding from the receptacles 184, whereafter the second wiper device 350, disposed substantially perpendicularly with respect to the packaging direction 110, is then brought into engagement with any pills 200 still protruding from the receptacles 184 following engagement with the first wiper device 300. The first and second wiper devices 300,350 are oscillated substantially transversely to the packaging direction 110 so as to vibrate laterally with respect to the blister package 180, concurrently with the respective engagements of the first and second wiper devices 300,350 with the protruding pills 200, and thus cause any protruding pills 200 to be manipulated into a laid-down position in the corresponding receptacles 184. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for packaging pills in individual receptacles in a web being conveyed in a packaging direction, said method comprising:

depositing pills into the receptacles;

engaging a first wiper device with any pills protruding from the receptacles, the first wiper device being disposed non-perpendicularly with respect to the packaging direction;

engaging a second wiper device with any pills still protruding from the receptacles following engagement with the first wiper device, the second wiper device being disposed substantially perpendicularly with respect to the packaging direction; and oscillating the first and second wiper devices substantially transversely to the packaging direction such that the first and second wiper devices vibrate laterally with respect to the web, the lateral vibration of the first and second wiper devices, as the wiper devices engage any protruding pills, thereby causing the protruding pills to be manipulated into a laid-down position in the corresponding receptacles.

2. A method according to claim 1 wherein engaging a first wiper device further comprises engaging a first wiper device, disposed at an angle of about 45 degrees with respect to the packaging direction, with any pills protruding from the receptacles.

3. A method according to claim 1 wherein oscillating the first and second wiper devices further comprises oscillating the first and second wiper devices substantially transversely to the packaging direction with a vibration-inducing device operably engaged therewith.

4. A method according to claim 3 further comprising controlling a frequency of the transverse oscillation of the first and second wiper devices with a frequency controller operably engaged with the vibration-inducing device.

5. A packaging device for a pill packaging apparatus, the packaging device being adapted to cooperate with a plurality of pill receptacles, the receptacles being defined by a web and being conveyed by a conveyor under the packaging device in a packaging direction, so as to manipulate pills deposited in the receptacles into a laid-down position with respect to the receptacles, said packaging device comprising:

a first wiper device extending across die web and non-perpendicularly to the packaging direction, the first wiper device being configured to engage pills protruding from the receptacles; and a second wiper device disposed downstream of the first wiper device and extending across the web substantially perpendicularly to the packaging direction, the second wiper device being configured to engage any pills still protruding from the receptacles following engagement with the first wiper device, the first and second wiper devices being configured to oscillate substantially transversely to the packaging direction so as to vibrate laterally with respect to the web, the lateral vibration of the first and second wiper devices, as the wiper devices engage any protruding pills, thereby causing the protruding pills to be manipulated into the laid-down position in the corresponding receptacles.

6. A packaging device according to claim 1 further comprising a plate supporting the first and second wiper devices, wherein the plate is configured to be transversely oscillated with respect to the web so as to laterally vibrate the first and second wiper devices.

7. A packaging device according to claim 6 wherein the plate defines a slot extending therethrough, the plate being further configured to removably receive at least one of the first and second wiper devices such that the at least one of the first and second wiper devices extends through the slot so as to be capable of engaging the protruding pills.

8. A packaging device according to claim 7 further comprising a support member operably engaged with the plate and disposed adjacent to the slot, wherein at least one of the first and second wiper devices is configured to be removably engaged with the support member.

9. A packaging device according to claim 8 further comprising a clip member configured to cooperate with the support member so as to removably secure at least one of the first and second wiper devices to the support member.

10. A packaging device according to claim 7 wherein the receptacles are arranged in columns in the packaging direction and the plate defines at least one channel opposing the web and extending along the packaging direction, the at least one channel being further configured to have the slot extending thereacross so as to allow the at least one of the first and second wiper devices extending therethrough to engage the protruding pills.

11. A packaging device according to claim 2 further comprising at least one vibration-dampening device operably engaged with the plate and adapted to substantially isolate the vibration produced by the oscillating plate from the conveyor.

12. A packaging device according to claim 1 wherein first wiper device is disposed at an angle of about 45 degrees with respect to the packaging direction.

13. A packaging device according to claim 1 further comprising a vibration-inducing device operably engaged with and configured to transversely oscillate the first and second wiper devices.

14. A packaging device according to claim 13 further comprising a frequency controller operably engaged with the vibration-inducing device and configured to control a frequency of the transverse oscillation of the first and second wiper devices.

15. A packaging device according to claim 13 wherein the vibration-inducing device further comprises a pneumatic vibrator.

16. A packaging device according to claim 1 wherein at least one of the first and second wiper devices comprises a cloth.

17. A packaging device for a pill packaging apparatus, the packaging device being adapted to cooperate with a plurality of pill receptacles, the receptacles being defined by a web and being conveyed by a conveyor under the packing device in a packaging direction, so as to manipulate pills deposited in the receptacles into a laid-down position with respect to the receptacles, said packaging device comprising:

a first wiper device extending across the web and non-perpendicularly to the packaging direction, the first wiper device being configured to engage pills protruding from the receptacles;

a second wiper device disposed downstream of the first wiper device and extending across the web substantially perpendicularly to the packaging direction, the second wiper device being configured to engage any pills still protruding from the receptacles following engagement with the first wiper device; and a plate extending across the web and supporting the first and second wiper devices, the plate being configured to oscillate substantially transversely to the packaging direction so as to cause the first and second wiper devices to vibrate laterally with respect to the web, the lateral vibration of the first and second wiper devices, as the wiper devices engage any protruding pills, thereby causing the protruding pills to be manipulated into the laid-down position in the corresponding receptacles.

18. A packaging device according to claim 17 wherein first wiper device is disposed at an angle of about 45 degrees with respect to the packaging direction.

19. A packaging device according to claim 17 further comprising a vibration-inducing device operably engaged with and configured to transversely oscillate the plate.

20. A packaging device according to claim 19 further comprising a frequency controller operably engaged with the vibration-inducing device and configured to control a frequency of the transverse oscillation of the plate.

21. A packaging device according to claim 17 wherein the plate defines a slot extending therethrough, the plate being further configured to removably receive at least one of the first and second wiper devices such that the at least one of the first and second wiper devices extends through the slot so as to be capable of engaging the protruding pills.

22. A packaging device according to claim 21 further comprising a support member operably engaged with the plate and disposed adjacent to the slot, wherein at least one of the first and second wiper devices is configured to be removably engaged with the support member.

23. A packaging device according to claim 22 further comprising a clip member configured to cooperate with the support member so as to removably secure at least one of the first and second wiper devices to the support member.

24. A packaging device according to claim 21 wherein the receptacles are arranged in columns in the packaging direction and the plate defines at least one channel opposing the web and extending along the packaging direction, the at least one channel being further configured to have the slot extending thereacross so as to allow the at least one of the first and second wiper devices extending therethrough to engage the protruding pills.

25. A packaging device according to claim 17 further comprising at least one vibration-dampening device operably engaged with the plate and adapted to substantially isolate the vibration produced by the oscillating plate from the conveyor.

26. A packaging device according to claim 17 wherein at least one of the first and second wiper devices comprises a cloth.

27. A pill packaging apparatus adapted to package pills in a plurality of pill receptacles defined by a web, said pill packaging apparatus comprising:

a conveyor for conveying the web therealong in a packaging direction;

a feeder mechanism configured to deposit pills into the receptacles; and a packaging device disposed downstream of the feeder mechanism with respect to the conveyor and configured to manipulate pills deposited in the receptacles into a laid-down position with respect to the receptacles, said packaging device comprising:

a first wiper device extending across the web and non-perpendicularly to the packaging direction, the first wiper device being configured to engage pills protruding from the receptacles; and a second wiper device disposed downstream of the first wiper device and extending across the web substantially perpendicularly to the packaging direction, the second wiper device being configured to engage any pills still protruding from the receptacles following engagement with the first wiper device, the first and second wiper devices being configured to oscillate substantially transversely to the packaging direction so as to vibrate laterally with respect to the web, the lateral vibration of the first and second wiper devices, as the wiper devices engage any protruding pills, thereby causing the protruding pills to be manipulated into the laid-down position in the corresponding receptacles.

28. A pill packaging apparatus according to claim 27 wherein first wiper device is disposed at an angle of about 45 degrees with respect to the packaging direction.

29. A pill packaging apparatus according to claim 27 further comprising a vibration-inducing device operably engaged with and configured to transversely oscillate the plate.

30. A pill packaging apparatus according to claim 29 further comprising a frequency controller operably engaged with the vibration-inducing device and configured to control a frequency of the transverse oscillation of the plate.

31. A pill packaging apparatus according to claim 27 wherein the plate defines a slot extending therethrough, the plate being further configured to removably receive at least one of the first and second wiper devices such that the at least one of the first and second wiper devices extends through the slot so as to be capable of engaging the protruding pills.

32. A pill packaging apparatus according to claim 31 further comprising a support member operably engaged with the plate and disposed adjacent to the slot, wherein at least one of the first and second wiper devices is configured to be removably engaged with the support member.

33. A pill packaging apparatus according to claim 32 further comprising a clip member configured to cooperate with the support member so as to removably secure at least one of the first and second wiper devices to the support member.

34. A pill packaging apparatus according to claim 31 wherein the receptacles are arranged in columns in the packaging direction and the plate defines at least one channel opposing the web and extending along the packaging direction, the at least one channel being further configured to have the slot extending thereacross so as to allow the at least one of the first and second wiper devices extending therethrough to engage the protruding pills.

35. A pill packaging apparatus according to claim 27 further comprising at least one vibration-dampening device operably engaged between the plate and the conveyor and configured to substantially isolate the vibration produced by the oscillating plate from the conveyor.

36. A pill packaging apparatus according to claim 27 wherein at least one or the first and second wiper devices comprises a cloth.

* * * * *

UNITED STATES PATENT AND TRADEMARK OFFICE

CERTIFICATE OF CORRECTION

PATENT NO. : 6,925,782 B2
DATED : August 9, 2005
INVENTOR(S) : Aylward

It is certified that error appears in the above-identified patent and that said Letters Patent is hereby corrected as shown below:

Column 10,
Line 48, “claim 1” should read -- claim 5 --.

Column 11,
Line 9, “claim 2” should read -- claim 6 --.

Signed and Sealed this

Eighth Day of November, 2005

JON W. DUDAS
*Director of the United States Patent and Trademark Office*